United States Patent [19]

Barry

[11] 4,015,384

[45] Apr. 5, 1977

[54] CONSTRUCTION OF TANK

[75] Inventor: Anthony Dermot Barry, Cork, Ireland

[73] Assignee: John A. Wood Limited, Victoria Cross, Ireland

[22] Filed: June 10, 1975

[21] Appl. No.: 585,457

[30] Foreign Application Priority Data

June 13, 1974 Ireland ..... 1237/74

[52] U.S. Cl. ..... 52/224; 52/246; 52/248; 52/741; 61/.5; 220/9 A

[51] Int. Cl.[2] ..... B65G 5/00

[58] Field of Search ..... 52/224, 225, 227, 245, 52/246, 248, 741; 220/9 A, 9 LG, 1 B, 18; 61/.5, 46

[56] References Cited

UNITED STATES PATENTS 3,300,916 1/1967 Pritzker ..... 52/246 X 3,609,930 10/1971 Crandal ..... 52/245

OTHER PUBLICATIONS

Engineering News-Record "Reinforced Concrete Reservoir" Apr. 29, 1954, pp. 61 & 62.

*Primary Examiner*—J. Karl Bell

[57] ABSTRACT

A water and slurry storage tank of relatively large capacity comprising a cylindrical tank whose side wall is formed from a number of concrete pipes. Each concrete pipe is provided with a hole adjacent the base of the tank to communicate with the interior of the tank. In this way stability of the concrete pipes under load is achieved and thus a readily available and relatively inexpensive unit namely a concrete pipe is used instead of more expensive prefabricated units.

14 Claims, 3 Drawing Figures

CONSTRUCTION OF TANK

BACKGROUND OF THE INVENTION

Introduction

The present invention relates the construction of and the manufacture of retaining walls, tanks, silos and large containers for liquids, slurries and granular material hereinafter referred to as tanks.

Field of the Invention

Water and slurry storage tanks where the capacity is greater than about 5,000 gallons are often manufactured from cast concrete. It is also known to provide a cylindrical water tank constructed from a plurality of upright pre-cast reinforced concrete beams, interlocked edge to edge longitudinally in the shape of a large cylinder. The adjacent longitudinally edges are jointed by cement grouting. It is also known to use hollow precast reinforced concrete beams. One of the disadvantages of the use of precast reinforced concrete beams is their relatively high cost. With previously constructed cylindrical tanks, when the walls comprised a plurality of upright precast hollow reinforced concrete beams it was necessary to provide relatively high tanks and it was therefore necessary to bind the exterior surfaces of the tank adjacent to the top and bottom thereof with some form of collar. For example, one particularly useful form of collar has been a plurality of pre-stressed high tensile wires. Adjacent to the top of such tanks it has been usual to provide a circular capping which may be cast in situ or may comprise a plurality of precast joined arcuate lengths of capping. Needless to say this has added further to the expense and to the difficulties of ensuring that the tank retains its strength during use.

Objects

The present invention is directed towards providing an improved construction of such tanks.

Another object of the invention is to provide a construction of a cylindrical tank which will use relatively inexpensive material.

A further object of the invention is to provide a method of erecting such tanks.

SUMMARY OF THE INVENTION

The invention provides a method of constructing a cylindrical tank including the steps of:

casting a concrete base;

erecting a plurality of concrete pipes, each having a hole in its cylindrical wall, around the base to form the wall of the tank, the pipes being arranged vertically with the holes facing inwards; and joining adjacent pipes together by a suitable grouting mixture.

The above and other objects and advantages of this invention will become apparent from the following detailed description of an embodiment in connection with the accompanying drawings.

DETAILED DESCRIPTION OF THE INVENTION

Figure 1:
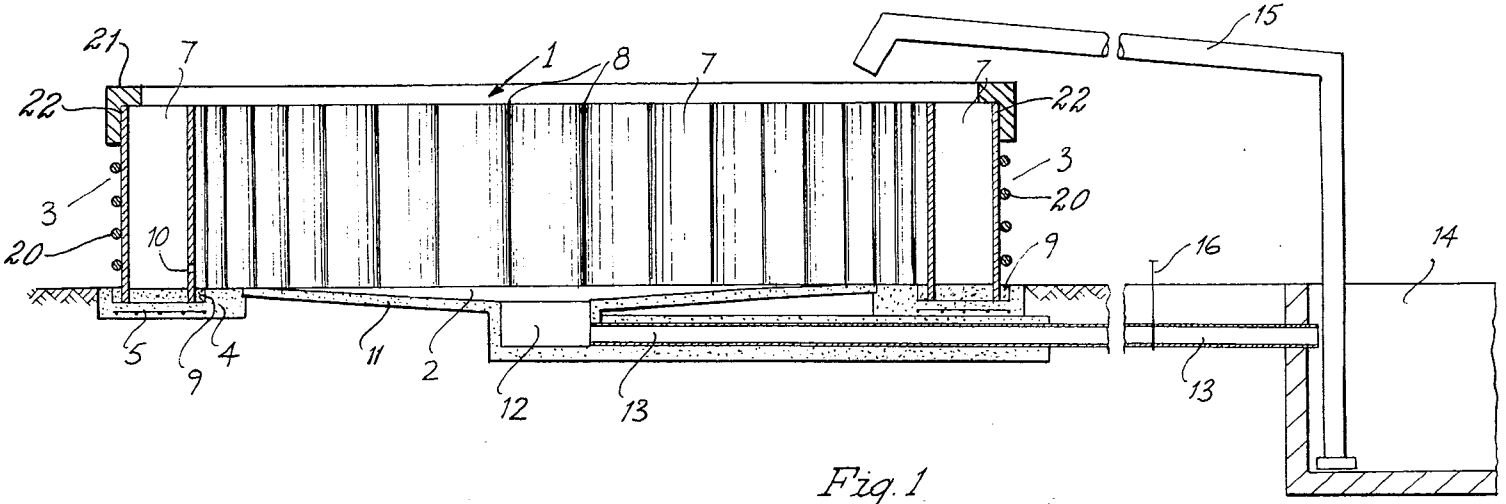
FIG. 1 is a side cross-sectional view of the slurry storage tank.
Figure 2:
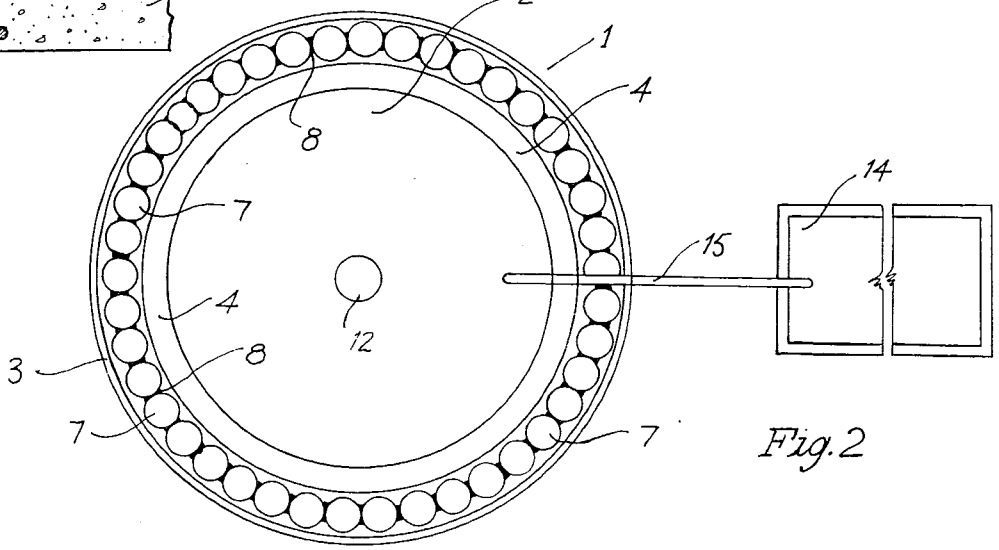
FIG. 2 is a plan view on a reduced scale of a larger slurry storage tank.
Figure 3:
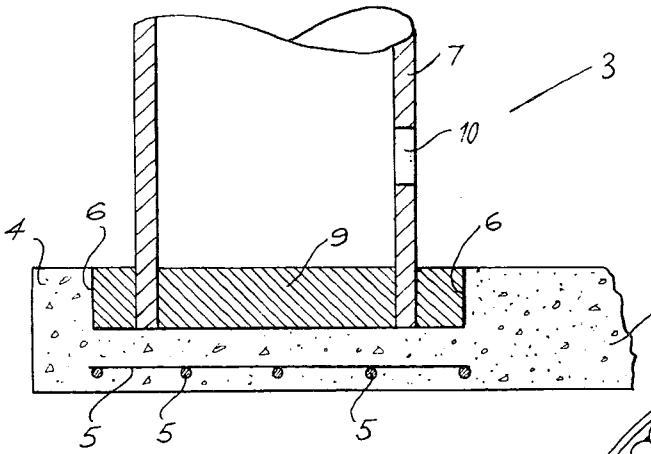
FIG. 3 is an enlarged view to FIG. 1 of portion of the tank illustrated in FIG. 1 with the capping member removed.

Referring to the drawings, there is provided a slurry storage tank, usually called a slurry tank and indicated generally by the reference numeral 1. The slurry tank 1 comprises a base and side walls, indicated generally by the reference numerals 2 and 3, respectively. The base 2 is of concrete and includes a ring member 4 incorporating mild steel reinforcing bars 5. (see FIG. 3). The ring member 4 has a recess 6 in which a plurality of concrete pipes 7 are erected. The concrete pipes 7 are grouted together by a suitable cementitious grouting mixture 8 to form the side walls 3. The recess 6 is backfilled with concrete 9. Each concrete pipe 7 is provided with a hole 10 adjacent the base 2 which connects the interior of the concrete pipe 7 with the interior of the slurry tank 1.

The base 2 includes a conical interior portion 11 sloping from the ring member 4 to a sump 12 adjacent the center of the slurry tank 1. The sump 12 is connected by a pipe 13 to a reception chamber 14. A delivery pipe 15 is connected between the reception chamber 14 and the slurry tank 1.

A suitable pump, now shown, and a stop-cock 16 is provided. In use, it will be appreciated that slurry, when delivered into the slurry tank 1 will flow through the holes 10 into the interior of each concrete pipe 7 thus adding to the stability of the concrete pipes. The slurry is delivered to and removed from the slurry tank in conventional manner via the reception chamber 14.

In previously constructed cylindrical tanks, when the walls comprised a plurality of upright precast hollow reinforced concrete beams it has been necessary to bind the exterior surface of the tank adjacent to the top and the bottom thereof with some form of collar. For example, one particularly useful form of collar has been a plurality of pre-stressed high tensile wires. Adjacent to the top of such a tank it has been usual to provide a circular capping which may be cast in situ or may comprise a plurality of precast jointed arcuate lengths of capping.

It will be appreciated that the use of relatively short lengths of concrete pipes according to the present invention overcomes the necessity for such a capping member. Needless to say, when it is desired to use long lengths of concrete pipes it may be desirable to bind the exterior of the tank to counteract any tendency of the joints to open. This is perferably achieved by placing a hooped band 20 around the outer periphery of the pipes and prestressing the band to form a pre-tensioned hooped band.

When additional rigidity is required, a capping member 21 may be provided around the periphery of the tank, said capping member comprising a precast circular ring having a groove 22 for the reception of the upper portion of the side wall. The capping member may form part of a roof or cover for the tank, according to the invention.

It will be appreciated that not only is the tank according to the present invention relatively easy to erect in use but it also has the added advantage of using relatively inexpensive and easily obtained materials namely concrete pipes.

A particularly suitable embodiment of the present invention provides a slurry tank manufactured from 24 inches I.D. concrete pipes of conventional construction approximately 6 ft. in height above the level of the base. A 17,000 gallon (U.S.) capacity tank may be provided by using thirty-four of these pipes, the tank having a mean diameter of 26 ft.: the said diameter being measured between the centers of the concrete pipes. It will be appreciated that, for example, a 120,000 gallon (U.S.) tank of the same height would require eighty nine concrete pipes of 24 inches I.D. and would have a mean diameter of 69 ft.

It is envisaged that the tank according to the present invention may be used for many other purposes, for example, it may be used for the storage of granular material. The construction of tank according to the present invention is particularly suitable for the storage of water.

I claim:

1. A cylindrical tank comprising:

a base;

a plurality of concrete pipes erected on the base each having its longitudinal axis perpendicular to the base and having a hole adjacent to the base to communicate with the interior of the tank; and means for grouting adjacent pipes together.

2. A cylindrical tank as recited in claim 1 in which the means for grouting adjacent pipes together is a cementitious mixture.

3. A cylindrical tank as recited in claim 1 comprising a pretensioned hooped band secured around the periphery of the side wall.

4. A cylindrical tank as recited in claim 1 comprising a capping member mounted around the upper periphery of the tank, said capping member comprising a precast circular ring having a groove for the reception of the upper portion of the side wall.

5. A cylindrical tank as recited in claim 1 in which the base includes a reinforced concrete ring member, having a recess for the reception of the pipes and in which the pipes are grouted into the recess by concrete.

6. A cylindrical tank as recited in claim 5 in which the means for grouting adjacent pipes together is a cementitious mixture.

7. A cylindrical tank as recited in claim 5 in which the base slopes from the ring member towards the center of the base to a drain off pipe below the base.

8. A cylindrical tank as recited in claim 5 comprising a pre-tensioned hooped band mounted around the periphery of the side wall.

9. A cylindrical tank as recited in claim 5 comprising a capping member mounted around the upper periphery of the tank, said capping member comprising a precast circular ring having a groove for the reception of the upper portion of the side wall.

10. A method of constructing a cylindrical tank including the steps of:

casting a concrete base;

erecting a plurality of concrete pipes, each having a hole in its cylindrical wall, around the base to form the wall of the tank, the pipes being arranged vertically with the holes facing inwards; and joining adjacent pipes together by a suitable grouting mixture.

11. A method of constructing a cylindrical tank as recited in claim 10 in which before erecting the concrete pipes a recessed circular groove is cast in the base for the reception of the pipes.

12. A method of constructing a cylindrical tank as recited in claim 10 comprising the additional step of placing a band around the periphery of the pipes intermediate their ends and pre-tensioning the band to retain the pipes in -position.

13. A method of constructing a cylindrical tank as recited in claim 11 comprising the additional step of placing a band around the outer periphery of the pipes intermediate their ends and pretensioning the band to retain the pipes in position.

14. The cylindrical tank of claim 7 in combination with a reception chamber coupled to said drain off pipe, and a delivery pipe connected between the reception chamber and the cylindrical tank.

* * * * *